US008459889B2

(12) United States Patent
Barth et al.

(10) Patent No.: US 8,459,889 B2
(45) Date of Patent: Jun. 11, 2013

(54) MULTI-DIMENSIONAL PRINT CUTTING HEAD

(75) Inventors: Matthew S. Barth, Rochester, MN (US); Jason S. Lee, Rochester, MN (US); Jason A. Rebhahn, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 399 days.

(21) Appl. No.: 12/813,561

(22) Filed: Jun. 11, 2010

(65) Prior Publication Data

US 2011/0305495 A1 Dec. 15, 2011

(51) Int. Cl.

| | |
|---|---|
| ***B41J 11/66*** | (2006.01) |
| ***B26F 1/08*** | (2006.01) |
| ***B26F 1/24*** | (2006.01) |
| ***B26D 3/08*** | (2006.01) |
| *B26D 7/00* | (2006.01) |

(52) U.S. Cl.

CPC ..... *B41J 11/663* (2013.01); *B41J 11/666* (2013.01); *B26D 3/085* (2013.01); *B26D 2007/005* (2013.01)

USPC ..... 400/621; 234/50

(58) Field of Classification Search

CPC . B26F 1/0092; B26F 1/24; B41J 11/666; B41J 11/663; B26D 3/085; B26D 2007/005

USPC ..... 400/621; 234/50; 101/226

IPC ..... B26F 1/04, 1/08, 1/20, 1/22, 1/24, B26F 1/62

See application file for complete search history.

(56) References Cited

U.S. PATENT DOCUMENTS

| | | | | |
|---|---|---|---|---|
| 2,761,513 | A * | 9/1956 | Stram | 234/50 |
| 3,224,671 | A * | 12/1965 | Johnson et al. | 234/50 |
| 4,506,999 | A | 3/1985 | Robertson | |
| 5,215,390 | A | 6/1993 | Stempfle | |
| 6,313,432 | B1 | 11/2001 | Nagata et al. | |
| 6,594,026 | B2 * | 7/2003 | MacDonald | 358/1.12 |
| 6,945,645 | B2 | 9/2005 | Baron | |
| 7,182,010 | B2 * | 2/2007 | Blank et al. | 83/338 |
| 7,625,146 | B2 * | 12/2009 | Vogel | 400/621 |
| 2003/0146943 | A1 | 8/2003 | Lehmkuhl et al. | |
| 2004/0085422 | A1 | 5/2004 | Kelley | |
| 2004/0094006 | A1 * | 5/2004 | McGarvey et al. | 83/303 |
| 2007/0095801 | A1 | 5/2007 | Todorokihara | |

FOREIGN PATENT DOCUMENTS

| | | |
|---|---|---|
| JP | 01-085785 | 3/1989 |
| JP | 03-202372 | 9/1991 |
| JP | 10-086466 | 4/1998 |
| JP | 2007161359 | 6/2007 |

* cited by examiner

*Primary Examiner* — Daniel J Colilla

(74) *Attorney, Agent, or Firm* — Lieberman & Brandsdorfer, LLC

(57) ABSTRACT

An apparatus and article for cutting print media associated with a printing process. A media cutting logic-controlled head is incorporated into printing hardware. The cutting head is provided with a plurality of cutting devices that may be implemented in the form of cutting pins. Control logic is provided to individually control an extension or actuation of each of the cutting devices. Multiple cutting devices may be simultaneously extended and retracted or activated and deactivated, to cut the media at multiple locations. The cutting head can be integrated with any of existing printers transforming a printer into a media cutting device capable of cutting two-dimensional complex shapes at the full line speed without requiring change in speed or reversal of the media at any point.

18 Claims, 4 Drawing Sheets

MULTI-DIMENSIONAL PRINT CUTTING HEAD

FIELD OF THE INVENTION

The present invention relates to a print cutting head for print media. More specifically, the invention relates to incorporation of a cutting device into a printer to support cutting a label during the printing process.

BACKGROUND OF THE INVENTION

Label printers are widely used within commerce markets including manufacturing, distribution, etc. Many label stocks used in these printers are purchased in a pre-designed and/or pre-cut format. The shapes of these labels may be very complex and it is costly and time consuming for the producer of these label stocks to create these complex label shapes. Furthermore, aligning these pre-cut stocks in the printer is a time-consuming and error-prone process, as the pre-cut label areas must be precisely aligned to place text and images in the correct area of a label. Accordingly, synchronizing printing and cutting process of the label in a single printing unit is a more efficient option enabling on demand label creation and accurate cutting.

Typical prior art cutting assemblies incorporated into printer hardware are implemented in the form of an incising head mounted on a printer carriage moving linearly perpendicular to the direction of media feed, a pantograph mounted incising head moving in two dimensions across the media, a fixed linear matrix of cutting devices mounted perpendicular to the direction of media feed, or a fixed linear incising device perpendicular to the direction of media feed. The main drawback associated with one or more of these approaches is that a separate and complex drive system is required for the cutting assembly to ensure the cutting performed at the speed at which the head assembly "flies" across the paper, and the output of the printer and requirements for control of the print head become dependent upon the requirements of the cutting head, including required speed of throughput, and any media stoppage or reversal that may be required to make a complex cut.

As shown above, cutting assemblies known in the art do not provide for cutting at the printer line speed and can not be adjusted for any type of printer. Accordingly, there is currently a need for a cutting apparatus that can be detachably integrated into any type of printing hardware to cut printed media at the full line speed and without affecting the control methods of the print head and rollers of the printing hardware. There is furthermore a need for a cutting apparatus to enable creating complex label shapes at a reasonable speed, to ensure any label can be generated on demand at any time.

BRIEF DESCRIPTION OF THE DRAWINGS

The drawings referenced herein form a part of the specification. Features shown in the drawing are meant as illustrative of only some embodiments of the invention, and not of all embodiments of the invention unless otherwise explicitly indicated. Implications to the contrary are otherwise not to be made.

SUMMARY OF THE INVENTION

Figure 1:
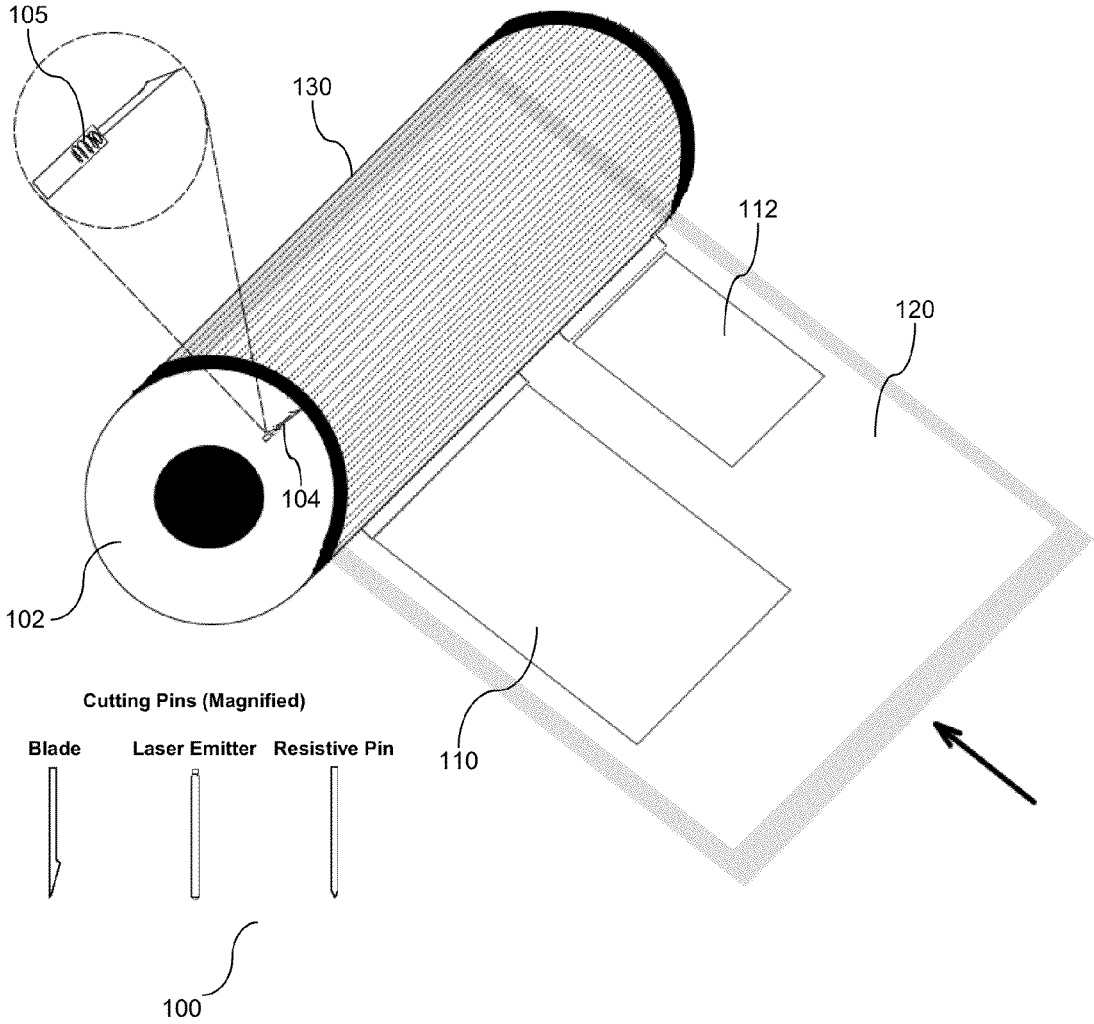
FIG. 1 is a perspective view of a print cutting head according to the present invention.

The invention comprises an apparatus and article to support multi-dimensional cutting of print media.

In one aspect, an apparatus is provided with a print cutting head configured to integrate into a printer unit. The print cutting head is configured for rotational movement, with the rotation of the print cutting head programmatically controlled. A plurality of cutting devices is provided in communication with the print cutting head. The cutting devices are arranged in a matrix pattern and configured to cut a print media in the printer unit. A processor is provided in communication with an actuation mechanism. Together, the processor and actuation mechanism control an extension of each of the cutting devices to form a two dimensional pattern as the print media passes by the print cutting head. A two-dimensional shape of the media is created during a print process of the media without affecting the print process, and with the cutting devices cutting the media in specific locations and at a specified thickness.

In another aspect, an apparatus is provided with a print cutting head integrated into a modular upgrade unit that may be selectively integrated with an existing printer unit. Rotation of the print cutting head is controlled by a secondary element that is either in the form of rotation of a paper feeding drum or programmatically controlled. A plurality of cutting devices is provided in communication with the print cutting head. These devices are arranged in a matrix pattern to cut a media in the printer unit. A processor is provided in communication with an actuation mechanism, with the actuation mechanism arranged to individually control an extension of each of the cutting devices to form any two dimensional pattern as the media passes by the print cutting head to create a two-dimensional shape of the media during a print process of the media and without affecting the print process. The cutting devices cut the media in specific locations and at a specified thickness. In addition, a connection mechanism is provided to connect the upgrade unit to the printer.

In yet another aspect, an article is provided with a print cutting head to integrate with a printer unit. Rotation of the print head is programmatically controlled. A plurality of cutting devices is provided in communication with the print head. The cutting devices are arranged in a matrix pattern to cut a print media in communication with the printer cutting head. A computer-readable storage medium is provided, including computer program instructions configured to individually manage actuation of the cutting devices. Instructions are provided to control an extension of each of the cutting devices to form any two dimensional pattern as the media passes by the print head and to create a two-dimensional shape of the media during a print process of the media without affect a rate of the print process. The cutting devices cut the media in specific locations and at a specified thickness.

Other features and advantages of this invention will become apparent from the following detailed description of the presently preferred embodiment of the invention, taken in conjunction with the accompanying drawings.

DETAILED DESCRIPTION

A modular media cutting logic-controlled head is provided. In one embodiment, the cutting head has a cylindrical form and rotates at a speed that is substantially equal to the full line speed of the printer. The cutting head is in communication with a plurality of cutting devices, including but not limited to pins, laser emitters, etc. Control logic is provided to individually control an extension and/or retraction of each of the cutting devices. Multiple cutting devices may be simultaneously extended and retracted to support a cutting of the media at multiple locations while accommodating the size and shape of the product. The cutting head can be integrated with an existing printer, thereby transforming the printer into a media cutting device capable of cutting two-dimensional shapes at the full line speed without requiring reversal of the media at any point. In one embodiment, the full line speed of the cutting head allows cutting to take place without affecting printing or requiring the throughput speed of the printer to be reduced, stopped, or reversed. Accordingly, the individual extension and retraction of the cutting devices supports a cut of the print media in the desired locations and at the desired thickness without relying on or requiring the media feed control to be slaved to that of the cutting head.

It will be readily understood that the components of the present invention, as generally described and illustrated in the Figures herein, may be arranged and designed in a wide variety of different configurations. Thus, the following detailed description of the embodiments of the apparatus, system, and method of the present invention, as presented in the Figures, is not intended to limit the scope of the invention, as claimed, but is merely representative of selected embodiments of the invention.

The functional units described in this specification have been labeled as tools, modules, and/or managers. The functional units may be implemented in programmable hardware devices such as field programmable gate arrays, programmable array logic, programmable logic devices, or the like. The functional units may also be implemented in software for execution by various types of processors. An identified functional unit of executable code may, for instance, comprise one or more physical or logical blocks of computer instructions which may, for instance, be organized as an object, procedure, function, or other construct. Nevertheless, the executables of an identified functional unit need not be physically located together, but may comprise disparate instructions stored in different locations which, when joined logically together, comprise the functional unit and achieve the stated purpose of the functional unit.

Indeed, a functional unit of executable code could be a single instruction, or many instructions, and may even be distributed over several different code segments, among different applications, and across several memory devices. Similarly, operational data may be identified and illustrated herein within the functional unit, and may be embodied in any suitable form and organized within any suitable type of data structure. The operational data may be collected as a single data set, or may be distributed over different locations including over different storage devices, and may exist, at least partially, as electronic signals on a system or network.

Reference throughout this specification to "a select embodiment," "one embodiment," or "an embodiment" means that a particular feature, structure, or characteristic described in connection with the embodiment is included in at least one embodiment of the present invention. Thus, appearances of the phrases "a select embodiment," "in one embodiment," or "in an embodiment" in various places throughout this specification are not necessarily referring to the same embodiment.

Furthermore, the described features, structures, or characteristics may be combined in any suitable manner in one or more embodiments. In the following description, numerous specific details are provided, such as examples of modules, managers, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

The illustrated embodiments of the invention will be best understood by reference to the drawings, wherein like parts are designated by like numerals throughout. The following description is intended only by way of example, and simply illustrates certain selected embodiments of devices, systems, and processes that are consistent with the invention as claimed herein.

In the following description of the embodiments, reference is made to the accompanying drawings that form a part hereof, and which shows by way of illustration the specific embodiment in which the invention may be practiced. It is to be understood that other embodiments may be utilized because structural changes may be made without departing form the scope of the present invention.

FIG. 1 is a perspective view illustrating a cutting head (100) that can be incorporated into a printer. The cutting head can be attached to an existing printer as an accessory thereto, or integrated into the printer as a component thereof. As shown here, the cutting head includes a cylindrical drum (102) with multiple cutting devices (104) in communication with the drum (102). The cutting devices (104) are arranged in a matrix pattern of multiple staggered rows (130) on the cylindrical drum (102). The cutting devices (104) are arranged such that all points of the area to be effected are covered by the cutting devices without gaps in cross-wise direction over a combination of rows. Accordingly, print media in the form of a label media can be simultaneously cut at multiple locations.

As shown herein, each position in the matrix includes a single cutting device (104). The individual cutting devices (104) may be homogeneous or heterogeneous. More specifically, each individual cutting device is in the form of a directional cutting pin with a sharp point and a tapered blade oriented in a manner opposed to the direction of feed of the media in the printer, or an omni-directional needle in the form of a pointed wire that can be electrified and heated by using resistance to an electrical current. With respect to the omni-directional needle, the heated wire can penetrate and cut the media in the printer. In one embodiment, both types of cutting devices described above may be interchangeably integrated into the same cutting head (102), or the two cutting functions may be incorporated into one pin design.

Each cutting device can individually be extended or retracted based upon supply of power to a rotational electric interface (not shown) in communication with the cutting head (102). In one embodiment, the power supply may employ a rotational electrical interface with the cutting head (102) for the purpose of signal transfer into the print cutting head, and one or more electro-magnetic solenoids to control the extension of the cutting pins. The rotational electric interface is widely used in the art for transferring electrical power or signals to a rotating device. In the present case, commands are transferred from a processor to the actuation mechanism, i.e. cutting devices, associated with the rotating cutting head. More specifically, each individual cutting device has an address and/or identifier; with the address being encoded in the actuation signal for each specific pin. The rotational electric interface directs the position of the cutting devices through the associated addresses to support extension and position of the individual cutting devices (104). Based upon the selection and arrangement of the cutting devices as addressed via the rotational electric interface, the cutting devices (104) serve as a perforator, router, or cutter depending on the depth of cut in the media defined by the amount of extension and length of time engaged. To further enhance the accuracy of the cutting of the print media, in one embodiment, a sensor is employed to accurately sense the position of the cutting device. As shown in FIG. 1, in one embodiment, a spring or damper (105) may be provided local to the cutting device (104) to control the movement of the individual cutting device. Alternatively, other actuation mechanisms may be adapted to control the cutting device extension. More specifically, mechanisms such as reversal of the current in the solenoid, variable magneto-rheological fluid based dampers for position control, or mechanical linkage control methods may be used.

As further shown, one or more platens (110) and (112) are provided to function in conjunction with the cutting head (100). The illustration shown herein is limited to a top surface of the platens (110) and (112), which are position to receive the print media (120) during the printing process. More specifically, as the print media (120) is processed across the drum (102), the platens (110) and (112) are positioned below the print media (120) to hold pressure against both the print media (120) and the cutting devices (104). In one embodiment, an inductive proximity sensor or pressure sensor may be provided in the platens (110) and (112) to sense pin engagement. Similarly, in one embodiment, a sensor suite to sense the position of the label stock and graphics on the stock may be embedded within the cutting head (102). In yet another embodiment, a sensor may be provided to read the thickness of the media to sense and set the depth of a cut when non-full depth cutting or routing is desired. Using this sensor, one or more layers of a multi-layered stock may be perforated, cut, or routed while other layers are left intact. Alternatively, a data store with stock characteristics can be accessed, or user entered thickness settings can be used.

As shown in FIG. 1, the cutting drum (102) is in contact with the entire width of the media (120) as it passes through the printer. The cutting head (102) supports cutting complex shapes in the media (120) of any width up to the maximum width that is supported by a given printer. The size and shape of the cutting drum (102) allows for continuous printing and cutting process without delay. In addition, the pin-matrix cutting head (100) in combination with an embedded control logic which enables cutting of the media (120) according to a specified design supporting all media lengths.

Figure 2:
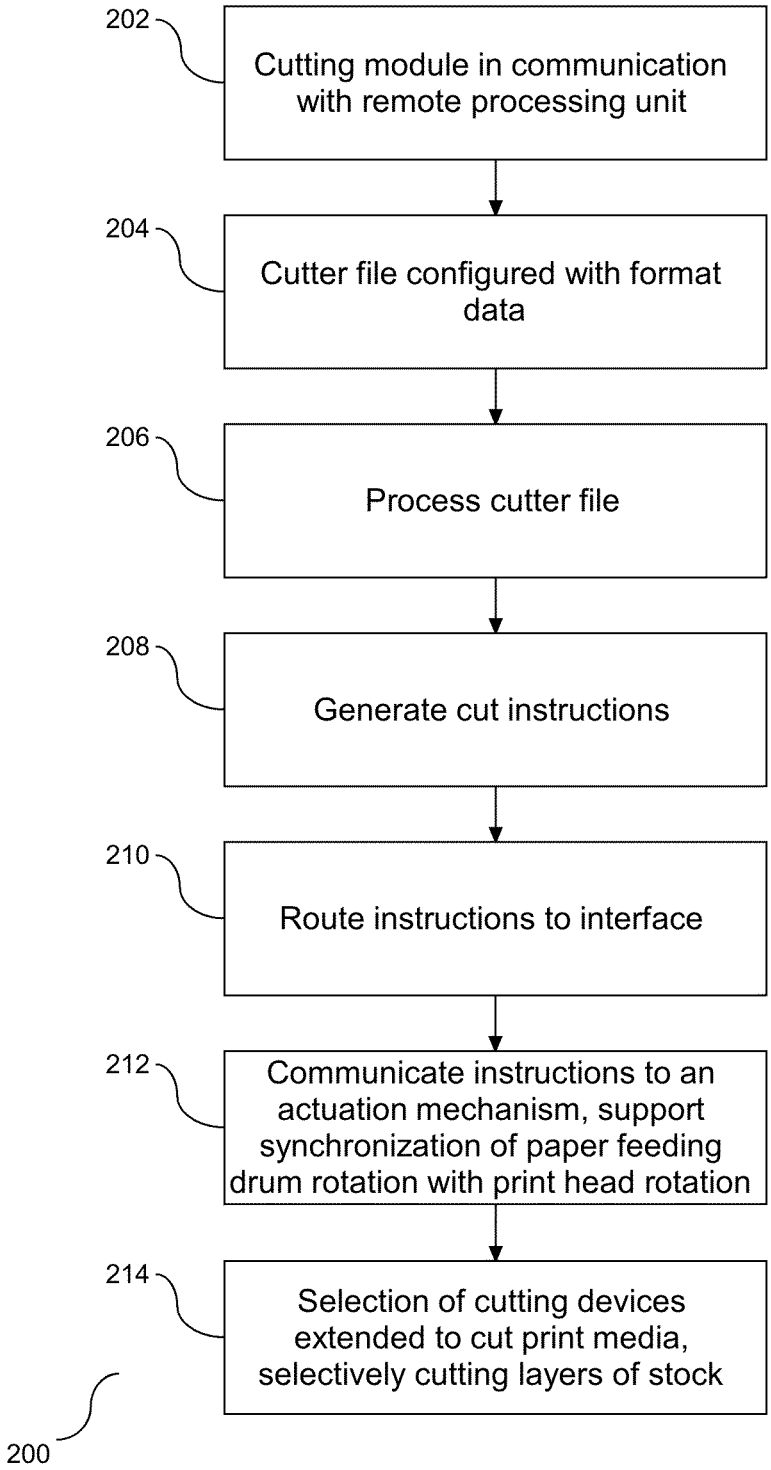
FIG. 2 is a flowchart illustrating a process for individually controlling extension of each cutting device in communication with the cutting head, wherein the processing is remote from the cutting head.

The cutting head (100) provides the physical tools to support the cut of the print media (120). In one embodiment a system of control logic is employed to control the extension of the cutting devices from the cutting head at the proper time. A set of instructions are employed to communicate the required actions from the logic to the individual cutting devices. As noted above, there are two different configurations, one in which the cutting head (100) is integrated directly into a printer, and a second in which the cutting head (100) is an accessory to the printer. FIG. 2 is a flowchart (200) illustrating a process for individually controlling extension of each of the cutting devices in communication with the cutting head wherein the processing is remote from the cutting head. More specifically, the cutting module is in communication with a remote processing unit (202). A cutter definition file is provided and configured with format data for a label (204). Each label definition in the file includes parameters defining the size, shape, and depth of the cuts of the media to create the defined label. The processing unit receives and processes a print file or the cutter definition file (206). Based upon a selected file, the processing unit generates cutting instructions (208). The instructions are routed to the rotational electrical interface in communication with the cutting head (210). The electrical interface local to the cutting head communicates the instructions received at step (210) to an actuation mechanism (212). In one embodiment, the communication of instructions at step (212) is a conversion of the instructions into analog signals to drive a specific cutting device actuator where the instructions are communicated to the actuation mechanism in the form of a serial signal containing commands to extend specific individual cutting devices in communication with the drum in order to make specific cuts in the media. In one embodiment, each of the individual cutting devices are arranged in a matrix containing multiple rows and columns, with each cutting device assigned to a specific row and column in the matrix, wherein each individual row and column includes a unique address and associated address identifier. The instruction at step (212) contains the unique address of each cutting device within the drum that is required to support an output label (214). More specifically, at step (214), a selection of the cutting devices in communication with the drum are extended and employed to cut the print media processing through the drum based upon the addresses provided in the cutter file. In one embodiment, may include the addresses of the cutting devices that need to be extended, as well as specific control information including, but not limited to, information defining the depth of cut, the speed at which the cutting device is extended or retracted, etc. It is known in the art that the paper feeding drum of the printer unit is supported by rotational movement. In one embodiment, the instructions at step (212) support synchronization of the rotation of the paper feeding drum with rotation of the print head. This synchronization may be in the form of instructions to programmatically control the print head rotation and support the coordination of between the feeding drum of the printer and the cutting devices of the print head. Accordingly, the processing power is provided in communication with the cutting head from a location remote from the cutting device.

Figure 3:
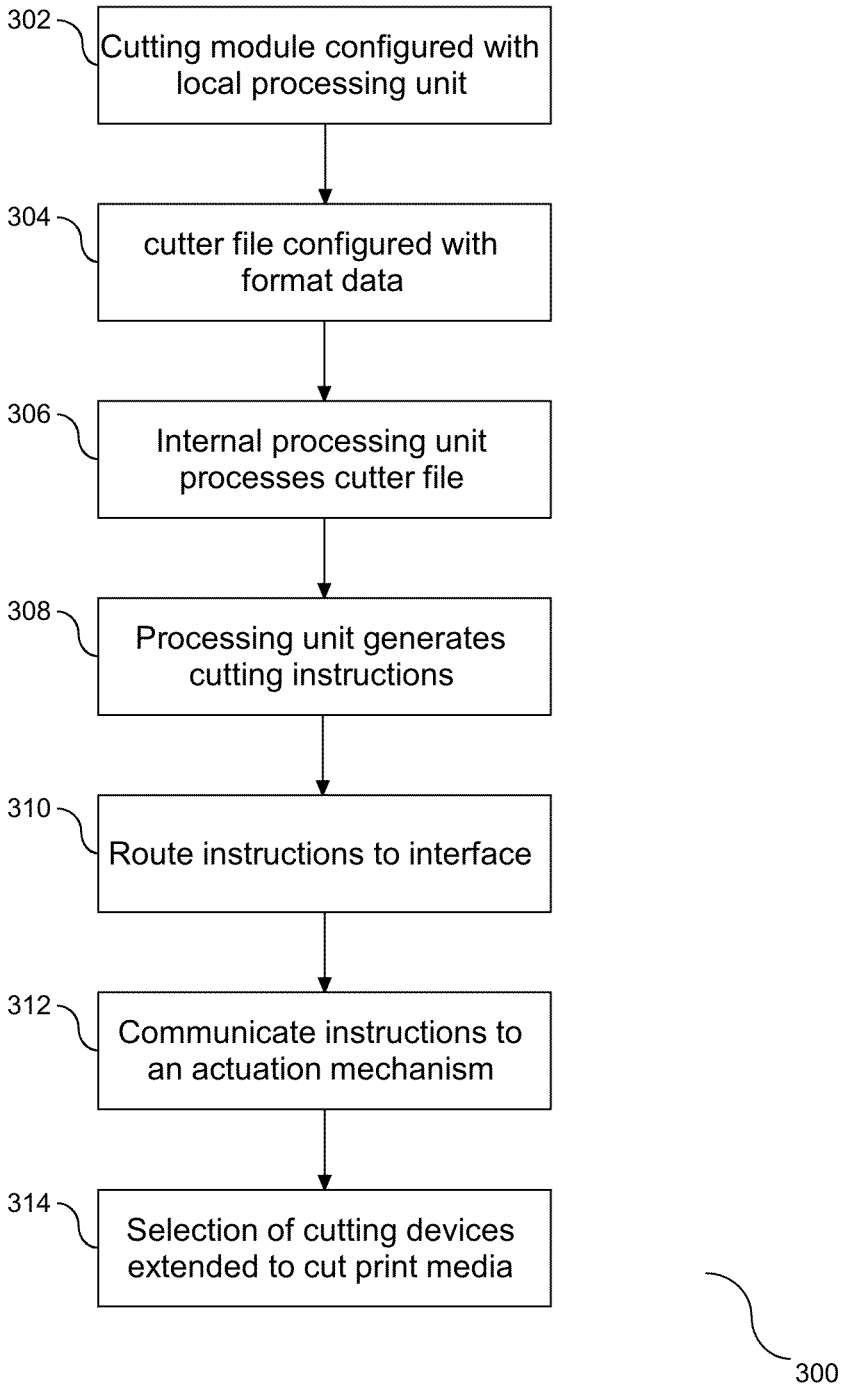
FIG. 3 is a flowchart illustrating a process for individually controlling extension of each of the cutting devices in communication with the cutting head, wherein the processing is local to the cutting head.

In another embodiment, a processor may be embedded within the cutting module to receive the raw cutting design configuration file, process it, and generate cutting instructions according to the embodiment described in FIG. 2. Generating cutting instructions by the processor local to the cutting module makes the cutting module independent of the printer, which would allow easy integration with any existing printer. FIG. 3 is a flowchart (300) illustrating a process for individually controlling extension of each of the cutting devices in communication with the cutting head wherein the processing is local to the cutting head. The cutting module is configured with a processing unit (302). A cutter definition file is provided and configured with format data for a label (304). Each label definition in the file includes parameters defining the size, shape, and depth of the cuts of the media to create the defined label. An internal processing device receives and processes the cutter definition file (306). Based upon a selected file, the processing unit generates cutting instructions (308). The instructions are routed to the rotational electrical interface in communication with the cutting head (310). The electrical interface local to the cutting head communicates the instructions received at step (310) to an actuation mechanism (312). More specifically, at step (314), a selection of the cutting devices in communication with the drum are extended and employed to cut the print media processing through the drum based upon the addresses provided in the cutter file. In one embodiment, the instructions may include the addresses of the cutting devices that need to be extended, as well as specific control information including, but not limited to information defining the depth of cut, the speed at which the cutting device is extended or retracted, etc. Similarly, in one embodiment, the communication of instructions at step (312) is a conversion of the instructions into analog signals to drive a specific cutting device actuator where the instructions are communicated to the actuation mechanism in the form of a serial signal containing commands to extend specific individual cutting devices in communication with the drum in order to make specific cuts in the media. In one embodiment, each of the individual cutting devices are arranged in a matrix containing multiple rows and columns, with each cutting device assigned to a specific row and column in the matrix, wherein each individual row and column includes a unique address and associated address identifier. The instruction at step (310) contains the unique address of each cutting device within the drum that is required to support the output label. In one embodiment, the instructions may include the addresses of the cutting devices that need to be extended, as well as specific control information including, but not limited, to information defining the depth of cut, the speed at which the cutting device is extended or retracted, etc. Accordingly, the processing unit is integrated with the cutting head as a cohesive unit.

In one embodiment, the invention is implemented in software, which includes but is not limited to firmware, resident software, microcode, etc. The invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, or transport the program for use by or in connection with the instruction execution system, apparatus, or device.

Figure 4:
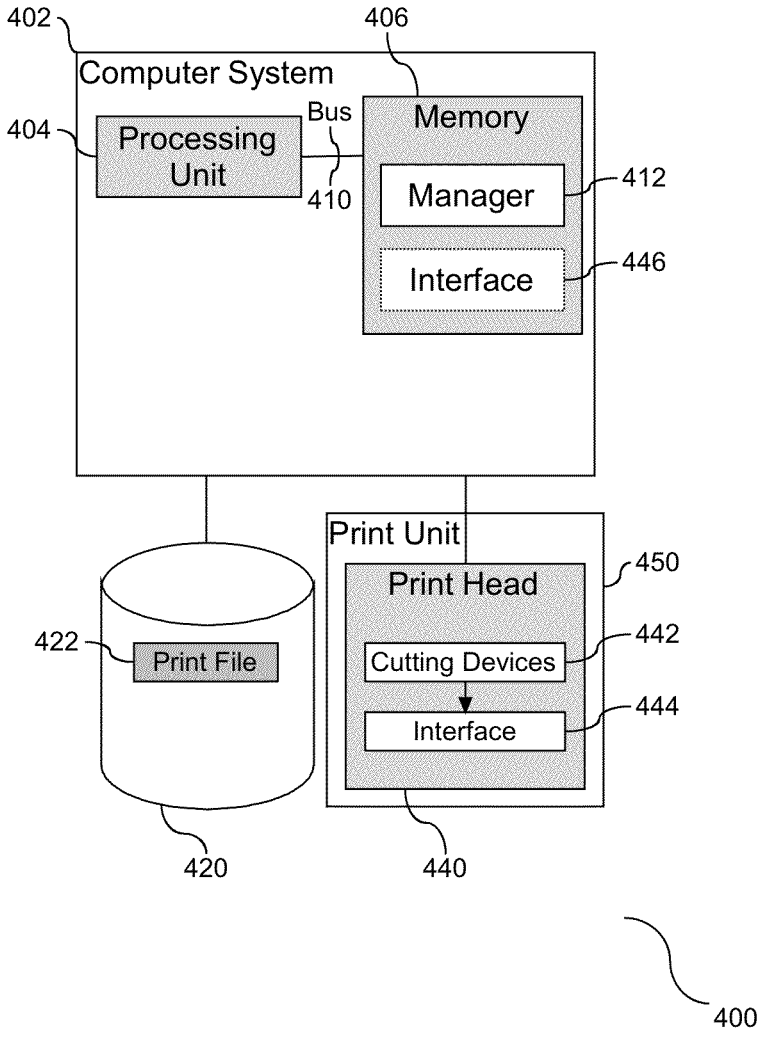
FIG. 4 is a block diagram illustrating a computer system in communication with the cutting head to support actuation of individual cutting devices of the cutting head.

FIG. 4 is a block diagram (400) illustrating a computer system in communication with the cutting head to support actuation of individual cutting devices of the cutting head. The illustration shows a computer system (402) in communication with data storage (420) and a print head (440) within a print unit (450). The communication with data storage (420) and/or the print head (440) may be local or remote across a network. The print head (440) is provided with a matrix of cutting devices (442) in communication with a rotational electrical interface (444) to control actuation of the individual cutting devices. The communication between the devices (442) and the interface (444) may be wired or wireless. The computer system (402) is shown with a processing unit (404) coupled to memory (406) by a bus structure (410). Although only one processor unit is shown, in one embodiment, the computer system (402) may include more processor units in an expanded design. As shown, the computer system is in communication with data storage (420). In one embodiment, the data storage (420) is employed to retain one or more print files (422) with specifications pertaining to extension and retraction of individual cutting devices to support the print media output. Similarly, in response to receipt of the print file, the processor communicates instructions to a manager (412) to generate cut instructions. The manager (412) creates and passes a serial signal to an interface (446) containing pin matrix addressing commands to make specific cuts in the print media. In one embodiment, the manager (412) may be in the form of a software control algorithm and interface (446), wherein the algorithm processes the printing and cutting design of the print media, and further provides instructions to control the cutting head and associated cutting devices through an interface (444) internal to a print unit (450).

As shown herein, the manager (412) and interface (446) reside in memory (406) local to the computer system (402). In one embodiment, the manager (412) may reside as a hardware tool external to memory (406), or it may be implemented as a combination of hardware and software. Accordingly, the manager (412) may be implemented as a software and/or hardware tool to manager the functionality of the cutting devices of the print head (440).

Embodiments within the scope of the present invention also include articles of manufacture comprising program storage means having encoded therein program code. Such program storage means can be any available media which can be accessed by a general purpose or special purpose computer. By way of example, and not limitation, such program storage means can include RAM, ROM, EEPROM, CD-ROM, or other optical disk storage, magnetic disk storage or other magnetic storage devices, or any other medium which can be used to store the desired program code means and which can be accessed by a general purpose or special purpose computer. Combinations of the above should also be included in the scope of the program storage means.

The medium can be an electronic, magnetic, optical, electromagnetic, infrared, or semiconductor system (or apparatus or device). Examples of a computer-readable medium include a semiconductor or solid state memory, magnetic tape, a removable computer diskette, random access memory (RAM), read-only memory (ROM), a rigid magnetic disk, and an optical disk. Current examples of optical disks include compact disk B read only (CD-ROM), compact disk B read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks.

The software implementation can take the form of a computer program product accessible from a computer-useable or computer-readable medium providing program code for use by or in connection with a computer or any instruction execution system.

The cutting head implemented according to the present invention can be incorporated in any type of printer and allows for on-demand creation of labels of any two-dimensional shape. Label media is cut, routed, or perforated subsequent to a printing process and at the full line speed of the printer without requiring reversal of the media at any point. Cutting devices in communication with the cutting head are arranged in a matrix pattern such that all points of the area to be effected are covered by a cutting device allowing for simultaneously cutting of the media at multiple locations.

It will be appreciated that, although specific embodiments of the invention have been described herein for purposes of illustration, various modifications may be made without departing from the spirit and scope of the invention. In particular, in one embodiment, the cutting head may be constructed of two cylinders sharing a common center point where one cylinder is contained within the other cylinder with the distance between the outside of the inner cylinder and the inside of the outer cylinder providing enough functional space for an actuation mechanism. The outer cylinder is in communication with cutting devices. The inner cylinder would be stationary containing the necessary processing and addressing device(s) with all of the corresponding data and power wires. The rotation of the outer cylinder containing the devices would be controlled by a label feeding roller of a printer. This allows for the outer rotating cylinder to rotate at the same speed as the label is being printed. As the outer cylinder rotates around the fixed inner cylinder, a single or multiple horizontal line(s) of contact oriented towards the point of contact between the outer cylinder and the label will enable control of the extension and retraction of cutting devices. Accordingly, the scope of protection of this invention is limited only by the following claims and their equivalents.

We claim:

1. An apparatus comprising:

a print unit including a paper feeding drum;

a print cutting head to integrate into the printer unit, wherein a rotation of the print cutting head is programmatically controlled by a processing unit;

a plurality of cutting devices on said print cutting head in communication with the processing unit, said cutting devices arranged in a matrix pattern to cut a media in said printer unit;

said processing unit in communication with an actuation mechanism, said actuation mechanism controlling an extension of each of said cutting devices forming a two dimensional pattern as said media passes by said print cutting head to create a two-dimensional shape of said media during a print process and without affecting the print process, wherein said cutting devices cut the media in specific locations and at a specified thickness.

2. The apparatus of claim 1, further comprising the processing unit synchronizing a rotation of said print cutting head with a rotation of the paper feeding drum.

3. The apparatus of claim 2, wherein said programmatic control of said print cutting head rotation includes a rotation speed change for said print cutting head.

4. The apparatus of claim 1, wherein the media includes multiple layers, and further comprising the processing unit directing selective cutting of the layers according to a predetermined shape and depth.

5. The apparatus of claim 1, wherein at least one of said cutting devices is selected from the group consisting of: a directional cutting pin, an omni-directional cutting pin, an extensible cutting pin, a matrix of fixed laser emitters, and combinations thereof.

6. The apparatus of claim 1, further comprising a unique address assigned to each cutting device and an electric interface in communication with each cutting device address to communicate individual device actuation.

7. The apparatus of claim 1, further comprising an internal interface to the print unit to control said print cutting head and cutting devices.

8. An apparatus comprising: a printer unit including a paper feeding drum, and a rotatable print cutting head selectively configured to integrate with the printer unit;

a plurality of cutting devices on said print cutting head in communication with a processing unit, said devices arranged in a matrix pattern to cut a media in said printer unit; and said processing unit in communication with an actuation mechanism, said actuation mechanism individually controlling an extension of each of said cutting devices forming a two dimensional pattern as said media passes by said rotatable print cutting head to create a two-dimensional shape of said media during a print process and without an affect on the print process, wherein said cutting devices cut the media in specific locations and at a specified thickness.

9. The apparatus of claim 8, further comprising the processing unit synchronizing a rotation of said print cutting head with a rotation of the paper feeding drum.

10. The apparatus of claim 9, wherein a rotation of said print cutting head is normally synchronized with the rotation of the paper feeding drum, and the processing unit changes rotation speed of the media.

11. The apparatus of claim 8, wherein the media includes multiple layers, and further comprising the processing unit directing selective cutting of the layers according to a predetermined shape and depth.

12. The apparatus of claim 8, wherein the cutting device is selected from the group consisting of: a directional cutting pin, an omni-directional cutting pin, extensible cutting pins, a matrix of fixed laser emitters, and combinations thereof.

13. The apparatus of claim 8, further comprising a unique address assigned to each cutting device and an electric interface to communicate with each address individual cutting device extension.

14. The apparatus of claim 8, further comprising an interface to provide instructions for control of said cutting head and cutting devices.

15. The apparatus of claim 14, further comprising said interface at a location selected from the group consisting of: internal to the printer and external to the printer.

16. An article comprising:

a print unit including a paper feeding drum;

a rotatable print cutting head to integrate with a printer unit;

a plurality of cutting devices on said print cutting head in communication with a processing unit, said cutting devices arranged in a matrix pattern to cut a print media in communication with said print cutting head;

a computer-readable storage medium, including computer program instructions configured to individually manage actuation of the cutting devices, the instructions controlling an extension of each of said cutting devices forming a two dimensional pattern as said media passes by said rotatable print cutting head to create a two-dimensional shape of said media during a print process of the media and without affecting the print process, wherein said cutting devices cut the media in specific locations and at a specified thickness.

17. The article of claim 16, wherein the processing unit synchronizes a rotation of said print cutting head with a rotation of the paper feeding drum.

18. The article of claim 16, wherein said programmatic control of said print cutting head rotation includes a rotation speed change for said print cutting head.

* * * * *